United States Patent [19]

Parisien

[11] 4,083,591

[45] Apr. 11, 1978

[54] GATE LATCH

[76] Inventor: Rudolph E. Parisien, 891 Rainbow St., Ottawa, Ontario, Canada

[21] Appl. No.: 719,593

[22] Filed: Sep. 1, 1976

[30] Foreign Application Priority Data

Sep. 22, 1975 Canada ..... 235968

[51] Int. Cl.[2] ..... E05C 3/26

[52] U.S. Cl. ..... 292/202; 292/238; 292/54

[58] Field of Search ..... 292/54, 238, 68, 71, 292/78, 213, 230, 238, 231, 299, 44, 50, 64, 202

[56] References Cited

U.S. PATENT DOCUMENTS

| | | | |
|---|---|---|---|
| 512,593 | 1/1894 | Webster et al. | 292/213 |
| 1,147,921 | 7/1915 | Berry | 292/71 |
| 1,264,244 | 4/1918 | Woiwod | 292/44 |
| 3,432,198 | 3/1969 | Connor | 292/216 |

*Primary Examiner*—Richard E. Moore

*Attorney, Agent, or Firm*—A. W. Breiner

[57] ABSTRACT

The gate latch is intended for use with gates which are capable of swinging through an arc of approximately 180 degrees. The latch finger secured to the gate may therefore pass through the latch if desired. The latch includes a hollow body secured to the gate post. A slot in the front wall of the body allows the latch finger to pass therethrough and one or more pawls are rotatably mounted in the body so as to trap the latch finger.

In one embodiment, a pair of pawls is provided and the latch finger engages one pawl which rotates out of its path and the latch finger is trapped between the pawls as the pawl returns to its rest position due to the action of gravity.

In another form of the invention a single rotatable pawl has a notch to engage the latch finger as the gate swings to the closed position. The pawl is then held there by co-operating means on the pawl and on the lower wall of the latch until it is released manually.

2 Claims, 9 Drawing Figures

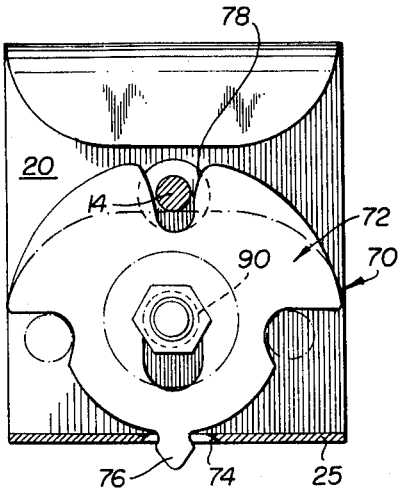
FIG.6
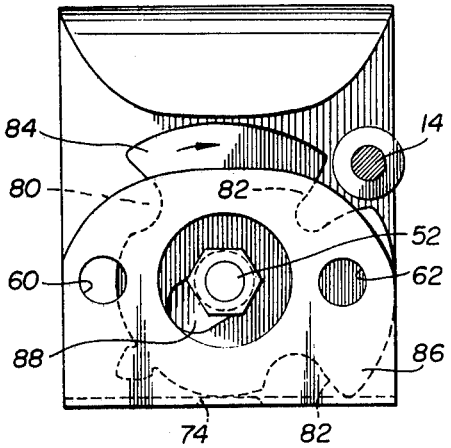
FIG.7
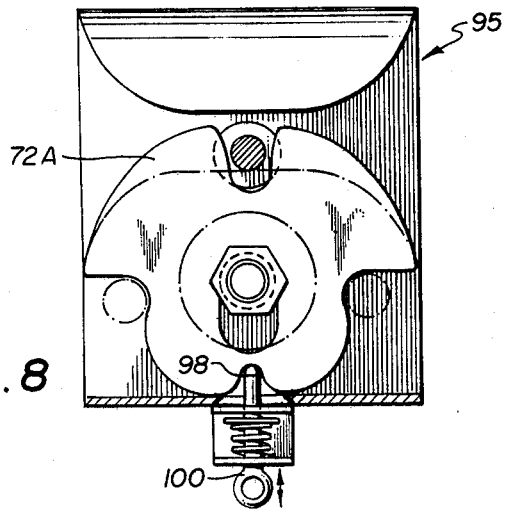
FIG.8
FIG.9
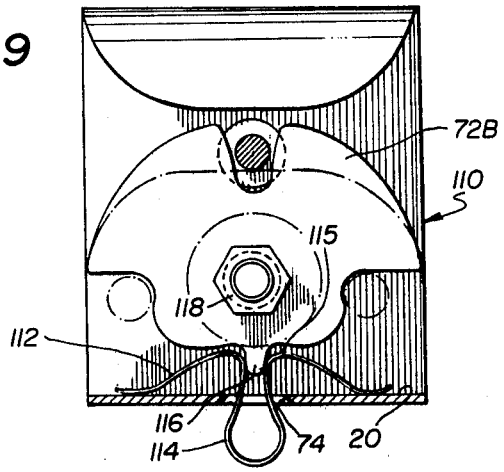

GATE LATCH

This invention relates to latches and more particularly to gate latches for swinging gates.

Known gate latches for use on swimming pool enclosures or the like are not entirely satisfactory in that the attaching means can usually be reached and the latch removed when the latch has been locked in the closed position. Although other parts of the fence might be removed to gain access it is believed desireable to render the enclosure more tamper proof by eleminating the temptation to remove the gate latch.

A further disadvantage of known gate latches is that of failing to provide a workable two way gate latch which will allow the gate to swing in either direction without periodically swinging right through.

It is therefore an object of the present invention to provide a gate latch which will allow the gate to swing in both directions but also provide a positive stop when desired to maintain the gate in a closed position.

A further object is the provision of fastening means which is concealed when the gate is in the closed position.

A still further object is the provision of a gate latch which can be locked from either side of the gate.

Accordingly the present invention provides a gate latch adapted to be secured to a gate post so as to be engaged by a latch pin on a gate adapted to swing toward the gate post said gate latch comprising a body including a backwall, a top wall having a downwardly depending flange and a bottom wall having an upwardly extending portion, and a pawl mounted for rotation between said back wall and said upwardly extending portion, said pawl being adapted to be deflected inwardly by said latch pin so as to cause said latch pin to be trapped in the body thus preventing return movement of said latch pin.

In the drawings which illustrate preferred embodiments of the invention:

FIG. 6 is a front elevational view, partly in section, of a modified version of the gate latch;

FIG. 7 shows the latch of FIG. 6 in the position prior to latching;

FIG. 8 shows a front elevational view of another modification similar to the latch of FIG. 6; and FIG. 9 is a front elevational view of a still further gate latch similar to that of FIG. 6.

Figure 1:
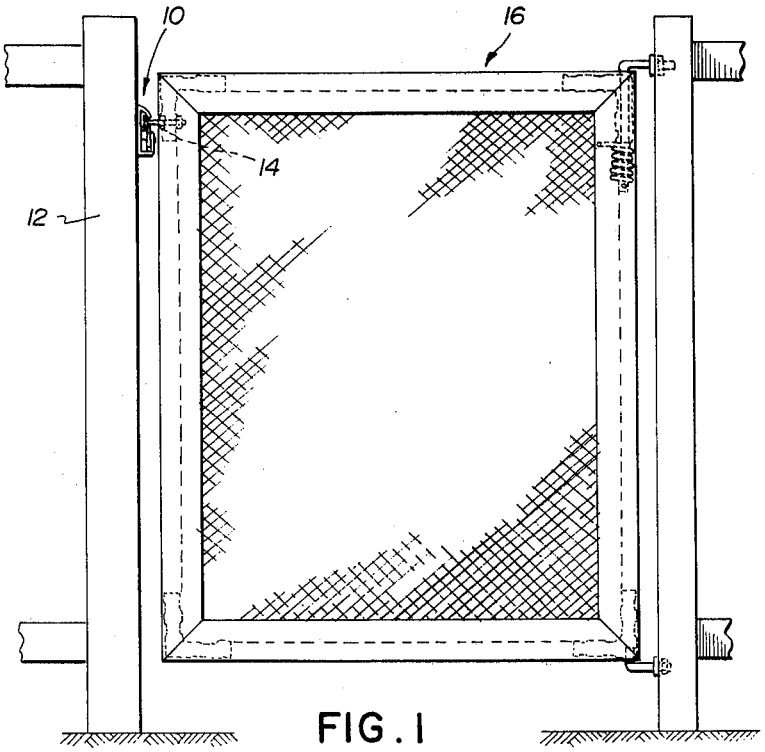
FIG. 1 is a front elevational view of a gate on which the gate latch of this invention has been installed.

Referring now in detail to the accompanying drawing a gate latch 10 in FIG. 1 is shown secured on a gate post 12 for cooperation with a latch finger 14 on a swinging gate 16.

Figure 2:
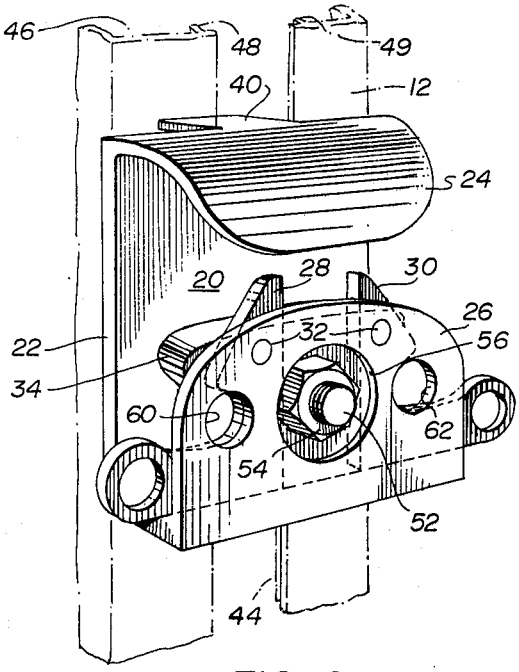
FIG. 2 is a perspective view of the gate latch of FIG. 1.

The latch 10 as shown more clearly in FIG. 2 comprises a body 20 including a back wall 22 having a downwardly depending flange 24 and a bottom wall having a upwardly extending portion 26.

A pair of substantially triangular pawls 28 and 30 are mounted for rotation between the back wall 22 and the upwardly extending portion 26 by conventional means such as rivets 32.

A spacer 34 integrally molded on the back wall 22 of the body provides a space between the pawls 28 and 30 and the back wall 22 so that a head 36 on the latch finger 14 will be received in and retained in the body 20.

Figure 3:
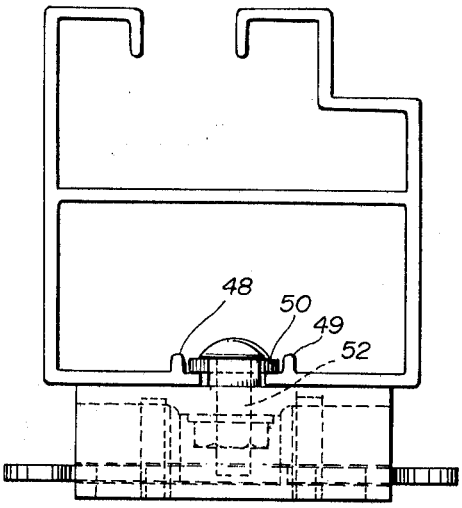
FIG. 3 is a top plan view of the gate latch of FIG. 1 and the gate post.
Figure 4:
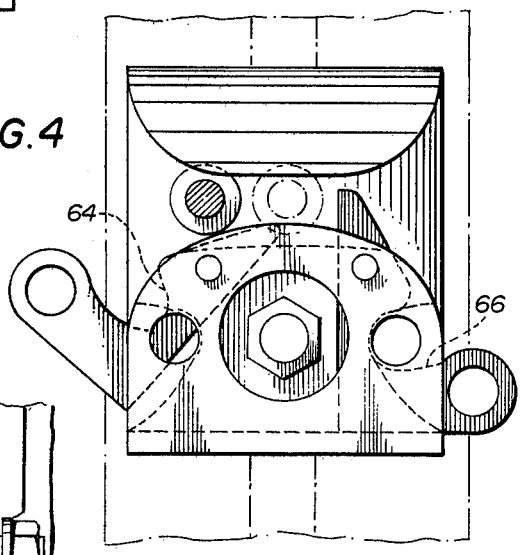
FIG. 4 is a front elevational view of the gate latch.

The latch 10 is particularly suited for mounting on a channel type post 12 in that it has lugs 40 and 42 on the reverse side of the back wall 22 of the body 20 adjacent the top and bottom. The lugs 40 and 42 are received in a restricted opening in 44 a channel 46 in the gate post 12. The lugs 40 and 42 prevent turning of the latch 10. It will be noted that the post 12 is also provided with ribs 48 and 49 on the interior of the post and spaced from the restricted opening as shown more clearly in FIG. 3. The ribs 48 and 49 prevent rotation of a sqared washer 50 which in turn prevents rotation of a bolt 52 since the washer has a square aperture and the bolt is of the type known as a carriage bolt. The bolt 52 extends through an aperture in the back wall 22 of the body and receives a retaining nut 54. Access to the bolt 52 is facilated by the provision of an aperture 56 in the body 20 large enough to receive a socket wrench. The nut 54 may be loosened at any time to provide for vertical adjustment of the latch 10.

The upwardly extending portion of the body 20 is also provided with a pair of apertures 60 and 62 at the sides of the apertures 56 to receive padlock (not shown) which prevents rotation of the pawls 28 and 30 when it is desired to lock the gate 16. The pawls 28 and 30 have indentations which are aligned with the apertures 60 and 62 to permit insertion of a padlock or both when the latches 28 or 30 are in the rest position shown in FIG. 2.

Figure 5:
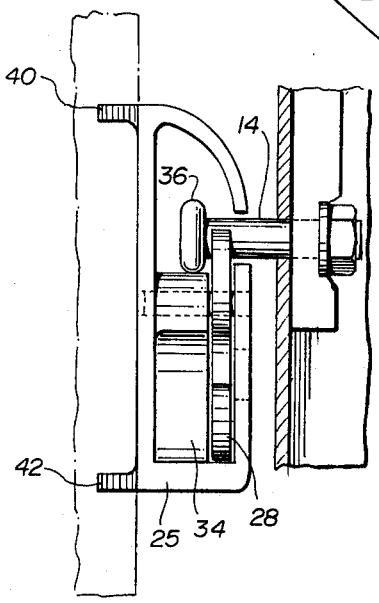
FIG. 5 is a side elevational view, partly in section, of the gate latch.

It should be noted that the length of the latch pin 14 extending from the gate 16 can be adjusted due to its threaded engagement with the gate. In FIG. 5 the latch pin is shown secured by means of a nut 15 or the latch finger 14 may be received in a threaded aperture in the corner key (not shown) of the gate 16.

In FIGS. 6 and 7 a modified gate latch is shown at 70 in which body 20 has a single pawl 72 mounted for rotation therein. It will be noted that the body 20 is substantially the same as that of FIGS. 1 to 5 with the exception that there are no rivets 32 and that an aperture 74 in the bottom wall 25 to receive a lug 76 on the lower portion of the pawl 72. The upper portion of pawl 72 is substantially semi-circular with an indentation 78 at the mid-portion of the upper edge to co-operate with the latch finger 14. The lower portion of the pawl 72 is also substantially semi-circular but of lesser radius than the upper portion so as to define indentations 80 and 82 to be aligned with apertures 60 and 62 in the body 20 in the locked position. The pawl 72 also has shoulders 84 and 86 one or other of which engage the bottom wall of the body when the pawl is in the unlatched position as shown in FIG. 7.

A centrally located oval aperture 88 in the pawl 72 receives the retaining bolt 52 and nut 54. It is also desirable to provide a sleeve 90 on the bolt 52 for the nut 54 to bear against.

In the position shown in FIG. 6 the latch finger 14 is locked in the indentation 78 and the pawl is kept from rotation by the lug 76 received in the aperture 74 in the bottom wall of the body.

In the position shown in FIG. 7 the pawl 72 has been moved in the direction of the arrow to release the latch finger 14 this is accomplished by pushing the lug 76 upwardly with the index finger of one hand while pushing the gate 16 in the desired direction. When the gate is again moved toward the latch position the latch finger will strike the pawl and move it in a counter clockwise direction (as shown in FIG. 7) so that the lug 76 will drop into the aperture 74 so as to lock the gate.

In FIG. 8 a latch 95 is shown which is similar in most respects to the latch of FIGS. 6 and 7 with the exception that the pawl 72A has been modified so as to have an indentation 98 in place of the lug 76 of the latch 70. A spring loaded pin 100 in a housing 102 is adapted to extend through the aperture 74 in the body and engage the indentation 98. The latch 95 is released by pulling the pin 100 out of engagement with the indentation 98. Locking of the gate takes place when the pawl 72A moves so that the pin 100 is depressed and on further rotation moves up to engage the indentation 98.

In FIG. 9 a further modification of the latch 70 of FIG. 6 is shown generally at 110 wherein a leaf spring 112 on the bottom wall of the body 20 has a loop 114 extending through the aperture 74 in the body 20. The spring 112 curves upwardly on both sides of the aperature to provide shoulders 115 which engage a projection 116 on a pawl 72B similar in other respects to the pawl 72 described above with the exception that it is provided with a round aperture rather than an oval aperture.

When the latch finger is in the latched position as shown in FIG. 9 the gate may be opened by pulling downwardly on the loop 114 of the spring 112 so as to lower the shoulders 115 thus releasing the projection 116 of the pawl 72B and allowing the pawl to rotate to free the latch finger 14.

The embodiments of the invention in which an exclusive property or privilege is claimed are defined as follows:

1. A gate latch adapted to be secured to a gate post so as to be engaged by a latch pin on a gate adapted to swing toward the gate post, said gate latch comprising a body including back wall, a top wall having a downwardly depending flange and a bottom wall having an upwardly extending portion, and a pawl mounted for rotation between said back wall and said upwardly extending portion, said pawl being adapted to be deflected inwardly by said latch pin so as to cause said latch pin to be trapped in the body thus preventing return movement of said latch pin, an upper portion of said pawl being substantially semi-circular and having an indentation at a mid-portion thereof to co-operate with said latch pin, a lower portion of said pawl being semi-circular and of lesser radius than said upper portion so as to define shoulders on each side of said pawl one or the other of which is adapted to engage said bottom wall or said body when said pawl is in an unlatched and manually releaseable means on said lower portion of said pawl and said bottom wall of said body for retaining said pawl in a closed position.

2. A gate latch as claimed in claim 1 wherein a lug on the lower portion of said pawl is adapted to be received in an aperture in said bottom wall of said body when said latch is in the closed position and said lug is adapted to be released from said aperture so as to move said pawl to the open position by manually pressing said lug upwardly.

* * * * *